US012287132B2

(12) United States Patent
Pizzo et al.

(10) Patent No.: US 12,287,132 B2
(45) Date of Patent: Apr. 29, 2025

(54) REGULATION METHOD AND REFRIGERATION PLANT AND RESPECTIVE REFRIGERATION PLANT INCLUDING SUCH APPARATUS

(71) Applicant: Carel Industries S.p.A., Brugine (IT)

(72) Inventors: Filippo Pizzo, Brugine (IT); Matteo Dal Corso, Brugine (IT); Dimitry Renesto, Brugine (IT)

(73) Assignee: CAREL INDUSTRIES S.P.A., Brugine (IT)

( * ) Notice: Subject to any disclaimer, the term of this patent is extended or adjusted under 35 U.S.C. 154(b) by 350 days.

(21) Appl. No.: 17/933,889

(22) Filed: Sep. 21, 2022

(65) Prior Publication Data

US 2023/0088707 A1 Mar. 23, 2023

(30) Foreign Application Priority Data

Sep. 23, 2021 (IT) ..... 102021000024482

(51) Int. Cl.
*F25B 41/22* (2021.01)
*F25B 39/00* (2006.01)
*F25B 49/02* (2006.01)

(52) U.S. Cl.
CPC ..... *F25B 49/022* (2013.01); *F25B 39/00* (2013.01); *F25B 41/22* (2021.01); *F25B 2500/19* (2013.01);
(Continued)

(58) Field of Classification Search
CPC ..... F25B 41/22; F25B 39/00; F25B 2500/19; F25B 2600/02; F25B 2700/1931; F25B 2700/1933; F25B 2700/197; F25B 49/022
See application file for complete search history.

(56) References Cited

U.S. PATENT DOCUMENTS 7,000,413 B2 * 2/2006 Chen ..... F25B 9/008 62/190
10,451,325 B2 10/2019 Sun et al.
11,428,447 B2 * 8/2022 Renesto ..... F25B 9/008

FOREIGN PATENT DOCUMENTS

EP 3059510 A1 8/2016
EP 3798533 A1 3/2021
(Continued)

OTHER PUBLICATIONS

Extended European Search Report corresponding to EP22196921.5, dated Feb. 13, 2023 (4 pages).
(Continued)

*Primary Examiner* — Nael N Babaa
(74) *Attorney, Agent, or Firm* — LUCAS & MERCANTI, LLP

(57) ABSTRACT

Described is a regulation apparatus for a refrigeration plant having defined therein a refrigerant fluid path and a plurality of devices arranged along the refrigerant fluid path. The regulation apparatus includes a first sensor arranged in a first point (P1) and a second sensor arranged in a second point (P3), each along the fluid path of the refrigeration plant, a control unit and an actuation device. The control unit controls a first value measured by the first sensor and obtains a first regulation request deriving from the first measured value as well as a second value measured by the second sensor and derives a second regulation request deriving from the second measured value, compares the first and second regulation requests, and establishes which regulation request is greater. The control unit also commands the actuation device to actuate the most effective regulation request of the refrigeration plant devices.

21 Claims, 4 Drawing Sheets

(52) U.S. Cl.
CPC ... *F25B 2600/02* (2013.01); *F25B 2700/1931* (2013.01); *F25B 2700/1933* (2013.01); *F25B 2700/197* (2013.01)

(56) References Cited

FOREIGN PATENT DOCUMENTS

| | | | |
|---|---|---|---|
| GB | 2269684 | A | 2/1994 |
| JP | H09126176 | A | 5/1997 |

OTHER PUBLICATIONS

Office Action dated Feb. 13, 2024, which was issued for the corresponding European patent application No. 22196921.5, (4 pages).
Search Report for Corresponding Italian Application No. IT 102021000024482, dated May 6, 2022 (8 pages).

* cited by examiner

REGULATION METHOD AND REFRIGERATION PLANT AND RESPECTIVE REFRIGERATION PLANT INCLUDING SUCH APPARATUS

CROSS-REFERENCE TO RELATED APPLICATIONS

This application claims the benefit of priority from Italian Patent Application No. 102021000024482, filed Sep. 23, 2021, the contents of which are incorporated herein by reference.

FIELD OF THE INVENTION

This invention relates in general to the technical sector of a refrigeration plant, such as for example a refrigeration, air conditioning or heat pump plant. More specifically, the invention relates to a regulation method and a corresponding regulation apparatus for said refrigeration plant, as well as a refrigeration plant which includes, or which is associated with, said regulation apparatus.

According to the invention, the term refrigeration plant means a plant such as those indicated above which includes at least one compression device, a heat exchanger, at least one lamination unit and an evaporator.

BACKGROUND OF THE INVENTION

It is known that such a refrigeration plant is subject to numerous continuous changes due to changes in the conditions external to the plant which can determine significant variations in the load and power required for optimal operation. It follows that the performance of such a type of plant depends decisively on its dynamic behaviour. In particular, a high regulation quality with constant power control is required in the presence of large load variations.

For this purpose, it is known to provide a so-called regulation device arranged on a single device to control a physical quantity (pressure, temperature, humidity, flow rate, etc.) with the aim of modifying the operation of said device in feedback if the value of said physical quantity deviates from a predetermined reference value.

In particular, in the feedback controls, using suitable formulas, the input quantity to be controlled (for example the pressure) is linked with an output (request) which is the relative percentage of an actuator, which is able to intervene to modify the quantity to be controlled.

We speak of regulation or regulation request, since the calculation has a relative % as output, which is then translated according to the actuator according to its characteristics.

A regulation request is identified for an actuator of a device according to the instantaneous value adopted by the controlled variable. A simple regulation request is of the on/off type, that is to say, if a value of a quantity is higher than a set-point, the regulation device is activated. For example, if the device is a compressor, the compressor is switched on if the controlled quantity is greater than the setpoint. The compressor, on the other hand, is switched off when it reaches the setpoint, or is below the setpoint by a certain threshold.

In more advanced systems, so-called dynamic feedback control systems have been developed, that is to say a "proportional" or "modulating" regulation.

The logic underlying such a proportional regulation device is an adaptation of a regulating action produced by the recorded deviation: the greater the deviation from the set-point value, the more consistent must be the response produced. In analytical terms, the outlet of the regulator (u) is proportional to the deviation (e) at the input, as is evident from the following equation:

$$U(t)=b+Kp\ e(t)$$

where the two characteristic parameters of the proportional regulator appear: the proportional gain (or "proportional constant" or "coefficient of proportional action") and b that is to say the bias (or "reset") which is useful if you want to obtain an output that is not zero when the deviation is zero.

Such a regulation is useful in a refrigeration plant in particular both for the control of capacitors and for the control of compressors, or for the control of other actuators such as, for example, valves.

SUMMARY OF THE INVENTION

At the basis of the invention there is a recognition by the inventors of the present patent application that such a type of regulation, although advantageous from many points of view, can be not very efficient, and/or sometimes under certain conditions expose a refrigeration plant to operating conditions with reduced or unsatisfactory safety, especially in a complex system where the variables are many, the changes are dynamic and there are several interdependent devices to control.

The invention starts from the position of the technical problem of providing an improved regulation apparatus for a refrigeration plant, an improved regulation method in a refrigeration plant, and a refrigeration plant which includes the improved regulation apparatus with respect to those of the prior art.

This is achieved by means of a regulation apparatus, a method and a refrigeration plant according to the respective independent claims. Secondary features of the invention are defined in the corresponding dependent claims.

At the basis of the invention there is an acknowledgment that a regulation, with consequent greater safety of a refrigeration plant, can be better obtained by making a comparison between values of regulation requests in at least two points of a fluid path of the refrigeration plant on the basis of a deviation of a quantity with respect to a reference value, also called the set point. This is particularly important in the case of a control of pressures along the fluid path of the refrigeration plant to avoid that by controlling in certain conditions "only" a request linked to a pressure in one point, the other (in the other point) rises too much beyond undesired levels.

The evaluation of the regulation request in the two points of the fluid path can take place by direct measurement of a quantity to be controlled through the respective sensor or probe, or by measuring the quantity to be controlled at one point and deriving the same quantity to be controlled at another point.

A method and a respective regulation apparatus for a refrigeration plant are developed in accordance with the invention. The plant includes at least one or more devices of the refrigeration plant. The regulation apparatus includes a first sensor designed to be arranged at a first point along a fluid path of the refrigeration plant to detect a first value of a quantity, a second sensor designed to be arranged at a second point along the path of fluid of the refrigeration plant, or a calculation unit for calculating a second value of said quantity in said second point, and a control unit. In practice, the second sensor can be physically present, or it can be absent, and the quantity in the second point can be derived mathematically by means of a suitable calculation using a calculation unit. The computing unit can be part of the control unit.

Consequently, the second value of the quantity on which the second regulation request is calculated could derive from a second probe and therefore measured but the case can be included that said second value of the quantity can instead be estimated through a formula, for example with an offset fixed with respect to the value of the first pressure, or as a calculated value knowing the characteristics of valves present in the circuit or fluid path or of the ejector of the circuit or of the activation of low temperature compressors if present, or other similar correlations.

When pressure "measured by the second sensor" is mentioned in the invention, it should also be understood as pressure only derived or calculated appropriately.

It will be understood that the basis of the invention is the intuition to compare regulation requests and to select the regulation more suitable and/or most effective for a given plant, or choose a regulation request value most suited to the needs of the plant.

For example, for some controls, such as the control of a compressor, the greater request is chosen.

The control unit is configured to control a first value measured by said first sensor and to obtain a first request for regulating operating parameters of said one or more devices of the refrigeration plant deriving from said first measured value and wherein said control unit control is configured to control a second value measured by said second sensor or calculated by means of said calculation unit, and derive a second request for regulating operating parameters of said one or more devices of said refrigeration plant deriving from said second measured or calculated value, compare the first regulation request with the second regulation request, and establish which regulation request is more suitable and/or most efficient between the first regulation request and the second regulation request, and carry out the regulation on the operating parameters of said one or more devices of the refrigeration plant on the basis of the most suitable regulation request.

Preferably, as anticipated above, a regulation or regulation request is a calculation that has a relative percentage (%) as output. Consequently, in comparing the first regulation request with the second regulation request, relative percentages (%) are compared. The most suitable and/or most effective percentage (%) is then established and chosen. The most suitable and/or most effective percentage (%) is then translated or transformed into a regulation command suitable for said actuation device.

Preferably this is the greater request.

The expression "point" refers to a region or zone of the fluid path in the refrigeration plant where a certain quantity can be verified, such as pressure or other quantity.

Preferably, the device of the refrigeration plant to be controlled is a compressor or a plurality of compressors. In this case, the regulation request is a percentage linked to the total maximum capacity of the compressors installed. If a 50% request is calculated for one of the two sensors, or in general (if there is only one sensor) for one of the two points, and there are two identical compressors, one would switch on, but if there are four identical compressors installed with the same "request" at 50%, only two would switch on. In practice, the regulation request can be an overall regulation request for a plurality of devices, that is, for example, of compressors.

If the device of the refrigeration plant to be controlled were, for example, a valve, the regulation request % could be the opening of the valve between its maximum and its minimum. In the case of a fan, it is the fan speed for example.

At the basis of the invention there is the recognition of comparing in a cyclical manner at predetermined times $t_i$, which can correspond to cycles of a control program, at least two regulation requests for the two sensors, or in general for the two points. The total request is determined by choosing at each instant the greater of the requests for the first sensor and for the second sensor (or for the second point in general).

Preferably, the regulation request is a proportional regulation, that is, it is a regulation calculated with the following generic formula:

$$R_{eq}=K_p*e$$

$K_p$=gain;

and e=deviation [between quantities] ($g_i-g_{set}$)

$g_i$ means a quantity read by the respective sensor or point at instant i and $g_{set}$ is the set point or reference quantity at instant i. This quantity can be a constant value or a variable value in the case, for example, of a floating setpoint enabled.

Preferably, in the regulation apparatus according to the invention, the gain is not set but a so-called differential which is linked to the gain by the relationship:

$$K_p = \frac{1}{Diff*2}$$

More preferably, the regulation request is a proportional and integral regulation, also called P+I regulation, $$Req = K_p*\left(e + \frac{1}{T_i}*\int edt\right)$$

where: $K_p$=gain linked to the Differential by the relation:

$$K_p = \frac{1}{Diff*2}$$

$T_i$=Integral time [sec]

e=deviation ($g_i-g_{set}$)

As in the previous formulation, $g_i$ means a quantity read by the respective sensor or calculated in the respective point at instant i and $g_{set}$ is the set point or reference quantity at instant i. This quantity can be a constant value or a variable value in the case, for example, of a floating setpoint enabled.

Even more preferably, the proportional contribution is a so-called central band.

This means that when the quantity $g_i$ corresponds to the set point, the regulation request corresponding only to the proportional part is not 0, but 50%.

Even more preferably, but not necessarily, the integral component $\int e\,dt$ is kept constant and no longer increased at the instant "i" of the calculation, if the total request in the previous instant (i−1) is at its minimum or maximum (0% or 100%).

According to an embodiment, the refrigeration plant comprises at least one evaporator, also called a freezer, and a compressor located downstream of the evaporator in a refrigerant fluid path of the refrigeration plant. The plant further includes a heat exchanger and a receiver interposed in order between the compressor and the evaporator. In the receiver, the liquid part is separated from the gaseous part of the refrigerant fluid. The receiver is also connected directly, or indirectly, for example via a lamination valve or flash gas valve, to the compressor to send the gaseous part to the compressor under certain conditions, especially when the external environmental conditions are of high temperatures.

An ejector is interposed between the heat exchanger and the receiver and is configured to be connected to the evaporator. The heat exchanger is connected to a primary inlet of the ejector. The evaporator is connected to a secondary inlet of the ejector. The gaseous refrigerant leaving the evaporator can then be introduced into the secondary inlet of the ejector. Preferably, a check valve is interposed between the evaporator and the compressor to avoid backflow from the compressors to the evaporator in particular operating conditions, and preferably, a check valve is interposed between the evaporator and the secondary inlet of the ejector. In said refrigeration plant, the first sensor is placed downstream of the evaporator to measure a pressure of the gas leaving the evaporator, preferably upstream of the check valve, and the second sensor is placed upstream of the compressor (or alternatively the second point is upstream of the compressor), preferably downstream of the check valve, to measure or calculate a gas pressure under suction conditions by the compressor.

It is to be understood that the check valve is a member which has a flow blocking function in the opposite direction to that desired as a preferential one. The check valve is used to block a counter flow if the downstream pressure is greater than the upstream one. This can happen due to other causes of operation of the plant (ejector, start-up of low temperature compressors, etc.). Such valves usually act mechanically autonomously without any regulation. In other words, a check valve has the function of creating a preferential direction, that is to say, to prevent the return back.

The first regulation or first regulation request is a regulation request calculated downstream of the evaporator while the second regulation or second regulation request is a regulation request calculated upstream of the compressor. On the basis of the calculated regulation requests, it is verified which request is greater and consequently the compressor capacity is acted upon.

The device of the refrigeration plant to be actuated is therefore the compressor according to this embodiment.

The regulation apparatus and the method according to the invention envisage comparing the two requests and selecting the greater of the two requests, as the total request with which to actuate the compressor.

The control and comparison between the two regulation requests is continuously carried out over time, in order to regulate the operation of the compressor in feedback based on the value of the greater request. It must be understood that, in the context of the invention, the reference quantity for the regulation request may mean both the pressure and the temperature converted or read by the probe in the absence of the pressure probe, even if reference is made below only to the pressure.

It follows that according to the specific embodiment, the two quantities $g_{set}$ and $g_i$ indicated above are pressure quantities (or as mentioned other quantities that reflect the pressure, such as the temperature) which therefore result as $p_i$ pressure read at instant i and $p_{set}$ setpoint pressure at instant i.

It follows that according to the above-mentioned embodiment, the regulation request is calculated with the following formula:

$$Req = Prop + Integr = \left[0.5 + \left(\frac{1}{Diff * 2} * e\right)\right] + \frac{1}{Diff * 2} * \left(\frac{1}{T_i} * \int edt\right)$$

In particular, two regulation requests are calculated for each of which it is possible to set:

$K_p$(P1), that is to say, the constant of proportionality for the first sensor; $T_i$(P1)=at the time integral for the first sensor, Setpoint (P1)=at the reference pressure or setpoint value for the first sensor; $K_p$(P3), that is to say, the constant of proportionality for the second sensor or in general for the second point; $T_i$(P3)=at the integral time for the second sensor, Setpoint (P3)=at the reference pressure or setpoint value for the second sensor or in general for the second point.

By convention, therefore, in the context of the invention, P1 means the first sensor, and P3 means the second sensor.

The plant is therefore configured to calculate the deviations $$e1=(p_{iP1}-p_{set_P1})$$

$$e2=(p_{iP3}-p_{setP3})$$

In addition, compare at each instant i the two requests Req_p1 and Req_p3 and choose the greater of the two as the total request with which to actuate the compressor device.

As mentioned above, the present embodiment can also provide for the option of only proportional regulation wherein the integral contribution is simply not taken into account, or as a further alternative to have in addition also the derivative component.

$$Req = K_p * \left(e + \frac{1}{T_i} * \int edt + T_d * \frac{de}{dt}\right)$$

The derivative component with Ta is the derivative time in seconds and de/dt is the derivative of the deviation over time.

The aim of the derivative component is preferably to quickly compensate for deviation variations.

In other words, it is to be understood that within the scope of the invention any proportional control known in the prior art can be used, whether it is only proportional, proportional plus integral, or proportional plus integral and with derivative part.

Further advantages, characteristics and methods of use of the object of the invention will become evident from the following detailed description of its embodiments, presented merely by way of non-limiting examples.

It is however evident that each embodiment of the object of this disclosure can have one or more of the advantages listed above; however, no embodiment is required to simultaneously have all the listed advantages.

BRIEF DESCRIPTION OF THE DRAWINGS

Reference will be made to the accompanying drawings, wherein.

DETAILED DESCRIPTION OF THE INVENTION

Figure 1:
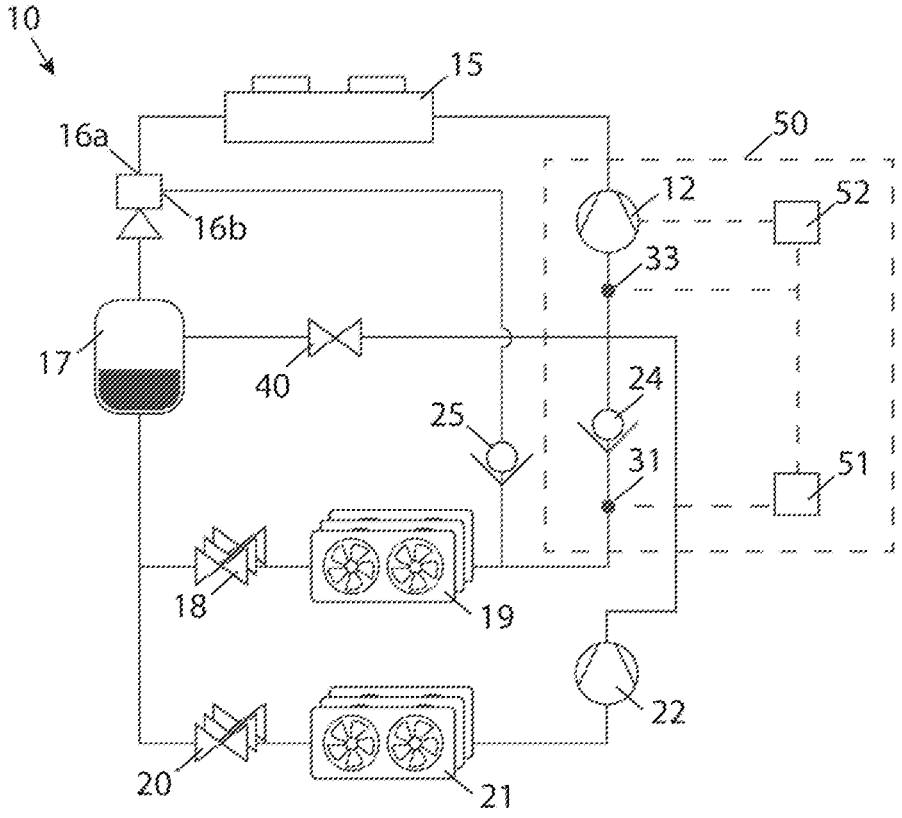
FIG. 1 shows a view of a diagram representing a refrigeration plant according to an embodiment of the invention.
Figure 2:
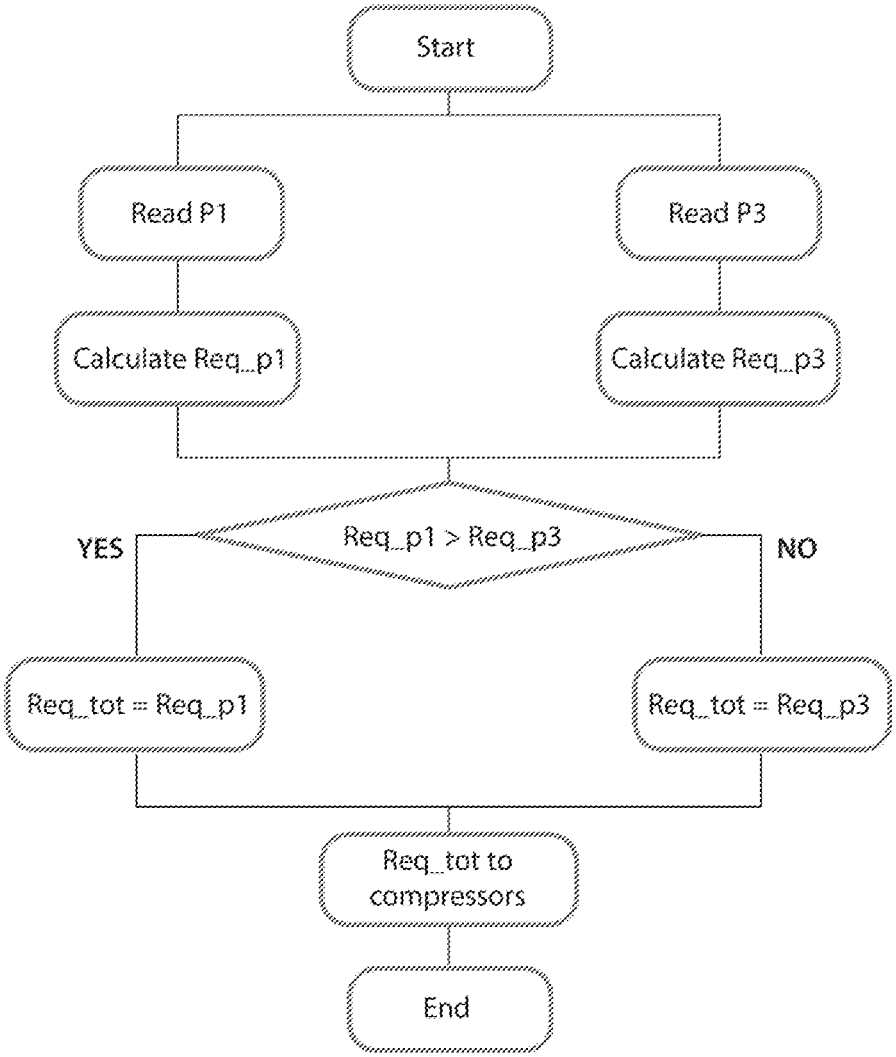
FIG. 2 shows a view of a block diagram representing a method for control or regulation of a refrigeration plant according to an embodiment of the invention.

With reference to the accompanying drawings, the numeral 10 denotes a refrigeration plant. The refrigeration plant 10 comprises, connected in fluid communication in a circuit, a compression device 12 or compressor, a heat exchanger 15, an ejector 16, a receiver 17, an expansion valve 18 and an evaporator 19. The compression plant 10 preferably includes in the embodiment shown at least a second expander 20 and a second evaporator 21 and a further compression device 22 to serve users at a low temperature with respect to the first above-mentioned components. Further expanders, evaporators and compression devices may be provided without departing from the scope of the invention.

In such a refrigeration plant 10, a fluid leaving the compression device 12 enters the heat exchanger 15 where it is cooled. The fluid leaving the heat exchanger 15 is introduced into a first inlet 16*a* in the ejector 16. An output of the ejector is normally connected to the receiver 17, where a liquid part of the fluid is separated from the gaseous part. The liquid part of the fluid is supplied to the evaporator 19, passing through the expander 18. The gaseous part of the refrigerant can be supplied to the compression device 12, as will described in more below. A further connection is provided between the evaporator 19 and a second inlet 16*b* of the ejector 16.

A first check valve 24 is preferably provided interposed between the evaporator 19 and the compression device 12, and a second check valve 25 is interposed between the evaporator 19 and the second inlet 16*b* of the ejector 16.

It will be noted that a fluid path is identified in the above-mentioned circuit which runs from the compression device 12 towards the receiver 17 passing through the heat exchanger 15 and the ejector 16, and which continues from the receiver 17 towards the compression device 12 passing through the expander 18 and the evaporator 19. A further fluid path is provided between the evaporator 19 and the ejector 16 passing through a respective check valve 25. With respect to said fluid paths, a downstream position and an upstream position for each component of the plant are identified in the circuit and in the plant. In other words, for each device of the refrigeration plant, a position upstream and downstream with respect to the path of the fluid in the region of the device is identified (and must be understood).

Therefore, for example, the ejector 16 is in a downstream position with respect to the heat exchanger 15 and the ejector 16 can be considered in a position upstream of the evaporator for the liquid part of the fluid, but downstream of the evaporator for a gaseous part that arrives from the evaporator passing through the check valve.

As is known, an ejector uses the Venturi effect to increase the pressure of the gaseous part at the second inlet by means of the fluid arriving at the first inlet.

Furthermore, the plant 10 includes a first probe 31 at the outlet from the evaporator 19, for example positioned upstream of the first check valve 24, and a second probe 33 positioned upstream of the compression device 12. In practice, the check valve 24 separates the outlet from the evaporator 19, for example a so-called medium temperature evaporator, from the inlet of the compression device 12. It will be noted that the first probe 31 is able to identify a pressure p1 which is the pressure at the outlet of the medium temperature evaporators, upstream of the first check valve 24. The second probe 33 is able to identify a pressure p3, that is to say the suction pressure at the compression device 12.

The first probe 31 and the second probe 33 are also part of a regulation apparatus 50, including a control unit 51 (or processing unit) operatively connected to the first probe 31 and to the second probe 33. The regulation apparatus 50 further includes an actuation device 52 operatively connected to the processing unit 51 and to the compression device 12 or compressor 12 to actuate the compressor on the basis of inputs received from the control unit 51. It should be noted that the second probe 33 may be absent or not used to measure the pressure. In this case, a pressure can be derived in the area of the second probe 33 (corresponding to a so-called second point) by deriving a calculated value, for example but not exclusively from the value of the pressure measured by the first probe 31, or from other characteristics of the plant, such as plant actuators. Where the second probe 33 is described, it must be understood implicitly that this probe could be absent and the relative pressure value is derived or calculated without direct measurement.

According to an aspect of the invention, in order to optimize an operation of the plant 10, a calculation is made of a request for regulation of the compression device 12 both on the basis of a pressure value measured by the first probe 31 and on the basis of a pressure value measured by the second probe 33, or derivative.

A system is therefore provided for calculating a first regulation request on the basis of the pressure value measured at the point of the first probe 31, and for calculating a second regulation request on the basis of the measured pressure value or, as mentioned, derived in the point of the second probe 33. The two regulation requests are compared and the greater regulation request is chosen as the total regulation request of the compression device 12.

In other words, a so-called comparison of regulation requests is performed on the basis of the pressure value measured upstream of the first check valve 24 and of the pressure value measured downstream of the first check valve 24 and therefore upstream of the compression device 12. In other words, a pressure reading p1, p3 is taken (or the latter calculated/derived) and, for each respective position in the circuit, a regulation request value is calculated, that is, a calculation of a regulation request to operate the plant in conditions of optimization for the position of the first probe 31 and of the second probe 33.

It follows that for each sensor or probe 31, 33, a regulation request occurs, that is, how much, for example, in percentage terms, a plant needs to be regulated to reach a reference value, in the area of the first probe, and in the area of the second probe respectively. The greater request is chosen as the total request with which to actuate the compression device.

The regulation apparatus 50 is therefore provided including the control unit 51 where a reference value or set point is stored for the quantity measured by the first sensor 31, and a reference value or set point for the quantity measured by the second. sensor 33, or, as mentioned, the derived quantity.

The calculation of the regulation request is also processed in the control unit 51.

More specifically, the control unit 51 is configured to compare the first regulation request on the first sensor with the regulation request on said second sensor 33, establishing which regulation request is greater between the first regulation request and the second regulation request. The control unit is configured to command the actuation device 52 to actuate the greater regulation request on the compressor 12.

Figure 3:
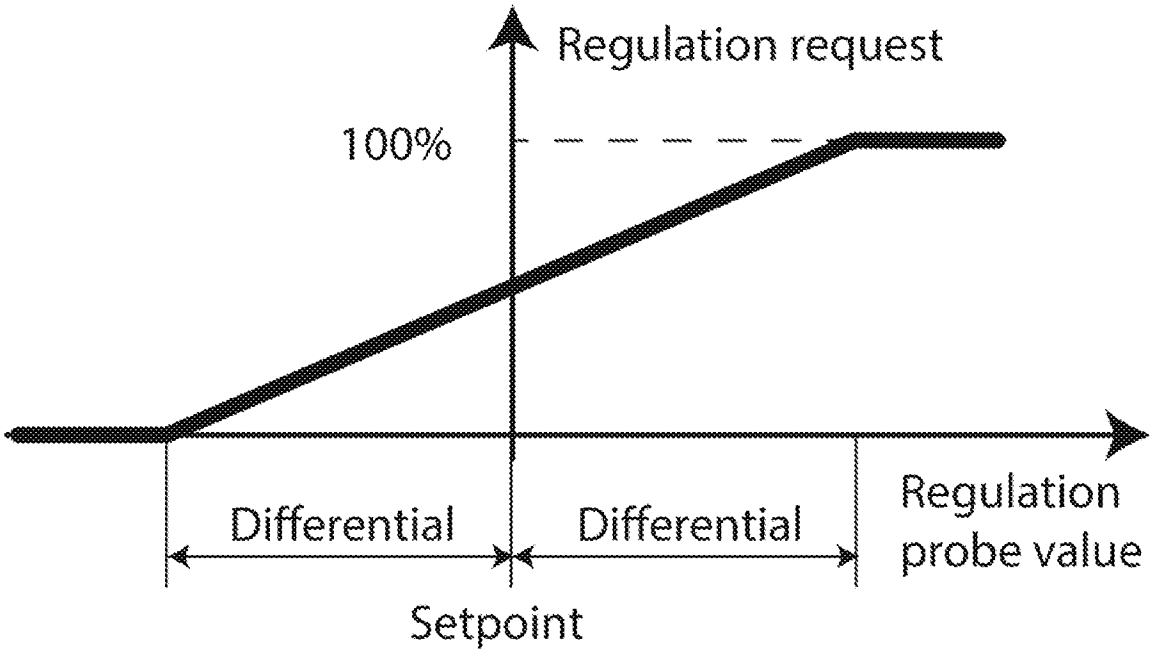
FIG. 3 shows a view of a graph relative to the regulation requests according to the proportional only mode.

More particularly with reference to FIG. 3, the regulation can be carried out based on a proportional regulation only.

The formula is therefore $$R_{eq}=\text{Prop}=e*K_p$$

It will be noted that, as shown in FIG. 3, the proportional contribution is central band, so when the pressure value corresponds to the setpoint value the request (proportional part only) is not 0 but 50%.

The calculation of the regulation request can be carried out with the proportional+integral mode, the so-called P+I mode.

The P+I regulation is calculated with the following formula $$Req = Prop + Integr = \left[0.5 + \left(\frac{1}{Diff*2}*e\right)\right] + \frac{1}{Diff*2}*\left(\frac{1}{T_i}*\int edt\right)$$

$T_i$=Integral time [sec]
e=deviation [barg]

$$e=(p_i-p_{set})$$

And in addition, Diff is linked to the gain according to the following formula $$K_p = \frac{1}{Diff*2}$$

$T_i$=Integral time [sec]
e=deviation [barg]

$$e=(p_i-p_{set})$$

With $p_i$ pressure read at instant i and $p_{set}$ setpoint pressure at instant i (it could be a constant value or variable in the case, for example, of a floating setpoint enabled). It is therefore possible to set a Diff (p1) for the first probe 31 and a differential Diff (p3) for the second probe 33.

In addition, the errors are calculated $$e1=(p_{iP1}-p_{set_P1})$$

$$e2=(p_{iP3}-p_{setP3})$$

In the case of P+I regulation, the integral action is added to the effect of the proportional action described above, which makes it possible to obtain a regulation deviation at zero speed. The integral action is linked to the time and the distance from the setpoint. It allows the request to be modified if the regulation value remains distant from the setpoint over time.

The value of the integral time set represents the speed of actuation of the integral control:

Low values result in quick and energetic regulations

High values result in slower and more stable regulations.

The two requests Req_p1 and Req_p3 are compared and the greater of the two is chosen as the total request with which to actuate the compression device 12.

It is to be understood that other calculation techniques can be envisaged starting from the concepts-principles described here.

It should also be noted that request calculation techniques according to the proportional or proportional+integral mode described here can also be applied to a single probe. For example, the calculation techniques can be applied in more standard refrigeration cycles, for example without an ejector, where it is necessary to calculate the feedback request on a quantity to be controlled, such as, for example, but not exclusively, the pressure control for the management of compressors in a simple refrigeration cycle. In any case, as mentioned, what is relevant for the invention concerns a comparison between requests and a comparison between the regulation requests and the selection of a maximum regulation request or a most suitable regulation request for said refrigeration plant.

Figure 4:
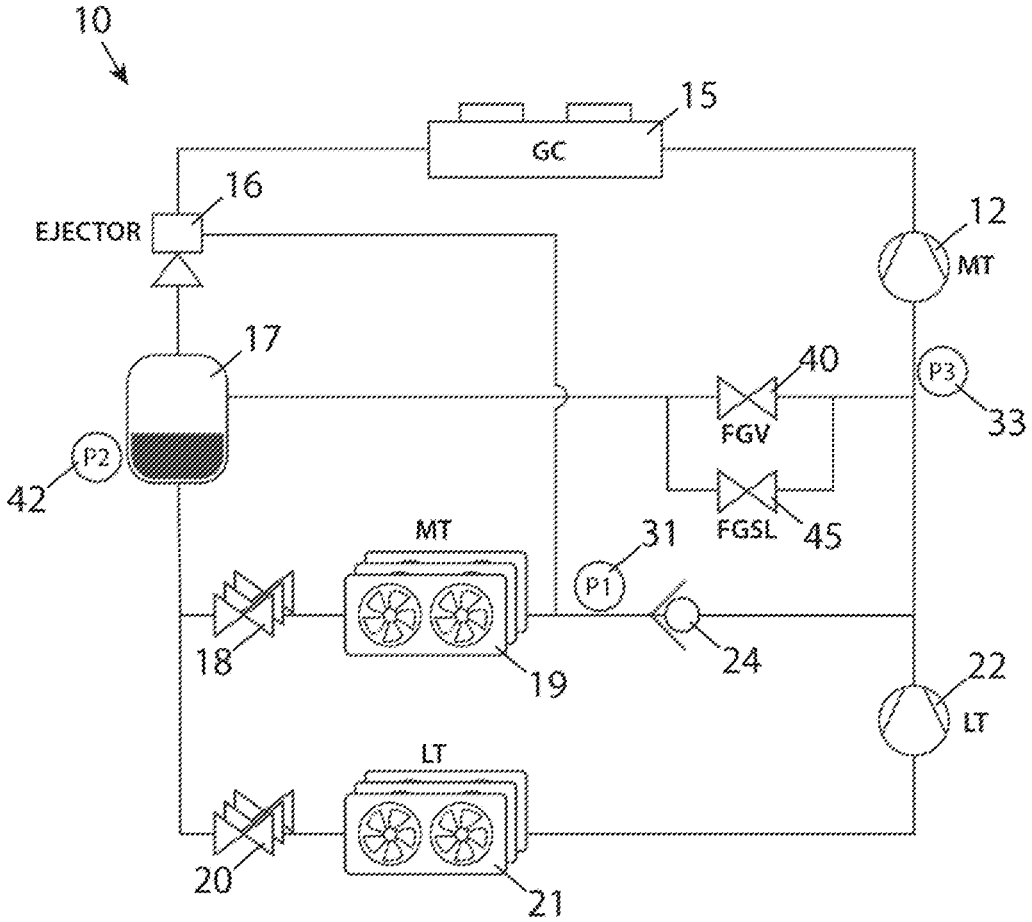
FIG. 4 shows a view of a diagram representing a refrigeration plant according to an alternative embodiment of the invention.

FIG. 4 illustrates a further refrigeration plant 10 with regulation apparatus according to an alternative embodiment of the invention. For this alternative embodiment, components having an identical function retain the same reference numerals.

In particular, with reference to FIG. 4, a refrigeration plant 10 includes a flash gas valve 40 for the interception of gas coming from the receiver 17. At the flash gas valve 40, which is also called a modulating valve, a third probe or third sensor is provided, denoted with reference numeral 42, which is capable of measuring a pressure P2 at the receiver 17.

In particular, when the ejector 16 is able to suck gas from the evaporator and therefore the first check valve 24 between the second sensor 33 and the first sensor 31 is closed (it does not allow the flow from the point of the second sensor 33 towards the point of the first sensor 31), in this case, except for the pressure drops, the pressure at the third probe 42 can be approximately equal to the pressure of the second sensor 33, that is to say, P2 is approximately equal to P3. Preferably, there is additionally an on-off (open/closed) type flash gas solenoid valve 45 installed in parallel with the flash gas valve 40 and with the same function, but to increase the passage area and reduce head losses due to the flash gas valve 40.

The flash gas valve 40 is managed with a conventional regulation called PID (Proportional+Integral+Derivative), calculated on a reference Delta called Delta_set, which can be set, compared with the Delta difference evaluated at each program run.

The Delta can be defined (as a user choice setting) as:

Delta=p2−p1 (with p1 value evaluated/measured at each program run)

Or

Delta=p2−p1_set (that is, comparing p2 not with the actual value of p1 but with the setpoint set for p1).

The aim is to keep Delta preferably within values that balance the optimal operation of the ejector between its capacity to create a pressure increase (lift defined as p2−p1) and the flow rate drawn by the evaporator 19.

Example Delta_set=3 bar (value that can be set by a user), at each program run the Delta difference is evaluated and consequently the PID regulation request of the flash gas valve 40 is calculated to reach the set Delta_set; if Delta>delta_set the valve opens, if Delta<Delta_set the valve closes.

The pressure p1 is typically measured by a transducer. The pressure p2 of the receiver can be measured by means of a transducer or derived from other known quantities as mentioned above in general for the measurement of a pressure in the refrigeration plant; for example if in the summer operation the ejector is able to suck the flow rate from the evaporator (from p1) generating an increase in pressure between p1 and p2 such as to close the check valve 24 which separates p1 from p3, in this case p2 is approximately equal to p3 less the pressure drops, so in this operation it is possible to deduce p2 from p3 with any offset.

In another sense, one of the characteristics of the ejector is the lift defined as the pressure difference p2−p1 which it is able to generate. Knowing the performance characteristic curve of the ejector 16, p2 could be obtained by adding to p1 the lift generated by the ejector itself, knowing its operating conditions at the instant evaluated, for example.

In practice, in addition to a comparison between the regulation requests for the first sensor and for the second sensor, there is also a specific management of the flash gas valve 40, which connects the receiver 17 with the suction of the compression device 12. This management is based on the pressures p1 and p2, where p2 is the pressure of the receiver 17.

In use, the gas, which is discharged from the receiver 17 towards the suction of the compression device 12 through this flash gas valve 40, can itself influence the trend of the pressure p3. Furthermore, this adjustment of the flash gas valve 42 has the aim of optimizing the delta pressure between p2 and p1 to make the ejector 16 work at its best, and therefore influencing the ejector will also indirectly influence p1 and p3 as trends in the machine.

As mentioned above, a flash gas solenoid valve 45 (FGSL) can be installed in parallel to the flash gas valve 42, therefore with non-modulating operation but completely open or closed.

In this case, a logic such as the following can be actuated:

If the opening of FGV>x % (where x % is a parameter which can be set, for example 90%) then after a certain delay time t in which FGV opening remains>x %, the opening of the FGSL valve is commanded. This valve can manage more flow with less pressure drops thus ensuring a rapid decrease of the Delta p2−p1 and at the same time leaving the FGV valve in parallel to regulate more finely.

If, on the other hand, the opening of the FGV valve falls below a threshold y % (where y % can be set and y %<x %, for example 70%) then, after a certain settable delay time t2, the FGSL valve is closed and only the FGV valve is regulated.

The invention, described according to preferred embodiments, allows the set aims and objectives to be achieved for overcoming the limits of the prior art.

The invention has thus far been described with reference to its embodiments. It is to be understood that there may be other embodiments pertaining to the same inventive core, all falling within the scope of protection of the claims set forth below.

The invention claimed is:

1. A regulation apparatus for a refrigeration plant, wherein a refrigerating fluid path is defined in the refrigeration plant and one or more devices are arranged along said refrigerating fluid path, wherein said regulation apparatus includes a first sensor arranged in a first point (P1) along the refrigerating fluid path of the refrigeration plant to detect a first value of a quantity in said first point (P1), a second sensor arranged in a second point (P3) along the fluid path of the refrigeration plant to detect a second value of said quantity in said second point (P3), a control unit, and an actuator to actuate at least one or more devices of the refrigeration plant, wherein said control unit controls the first value of said quantity measured by said first sensor and obtains a first request for regulation of said one or more devices of the refrigeration plant deriving from said first measured value wherein said control unit controls the second value measured by said second sensor and obtains a second request for regulation of said one or more devices of the refrigeration plant deriving from said second value measured for said second point (P3), wherein said control unit compares the first regulation request with the second regulation request and determines an improved safety regulation request that improves safety greater for said refrigeration plant between the first regulation request and the second regulation, and wherein said control unit controls the actuator to actuate the improved safety regulation request for said one or more devices of the refrigeration plant.

2. The regulation apparatus according to claim 1, wherein the improved safety regulation request is a greater regulation request of the first regulation request and the second regulation request.

3. The regulating apparatus according to claim 1, wherein said improved safety regulation request is a calculation having as output a relative percentage (%), and wherein said control unit compares the first regulation request with the second regulation request by comparing relative percentages (%), a percentage (%) that improves safety greater being then chosen and translated into an regulation command suitable for said actuator.

4. The regulation apparatus according to claim 1, wherein said at least one or more devices of the refrigeration plant to be controlled is a compressor or a plurality of compressors and the improved safety regulation request is the greater regulation request corresponding to the total capacity of said one compressor or a plurality of compressors in the refrigeration plant.

5. The regulation apparatus according to claim 4, wherein each of the first regulation request (Req_p1) and the second regulation request (Req_p3) is a percentage linked to the maximum total capacity of said compressor or plurality of compressors.

6. The regulation apparatus according to claim 1, wherein said control unit calculates each first regulation request (Req_p1) and second regulation request (Req_p3) by means of a proportional regulation calculated with the following generic formula:

$$Req=Kp*e$$

wherein Kp is a gain constant configured for the said at least one device; and e is a deviation between quantities, gi−gset, wherein gi means a quantity read by the respective sensor at the instant i, and gset is the set point or reference quantity in instant i.

7. The regulation apparatus according to claim 1, wherein said control unit calculates each first regulation request (Req_p1) and second regulation request (Req_p3) by means of a proportional and integral regulation, also called P+I regulation, according to the equation $$Req = K_p * \left(e + \frac{1}{T_i} * \int edt\right)$$

where: Kp=gain connected to the differential by the relation:

$$K_p = \frac{1}{Diff * 2}$$

Ti=Integral time [sec]

e=deviation (gi−gset)

and wherein Kp is a gain constant configured for said at least one device; and e is a deviation between quantities, gi−gset, wherein gi means a real value of said quantity at instant i and gset is the set point or reference quantity at instant i.

8. The regulation apparatus according to claim 7, wherein the proportional contribution is a central band such that when the quantity gi corresponds to gset the regulation request is 50%.

9. The regulation apparatus according to claim 1, wherein said control unit calculates each first regulation request (Req_p1) and second regulation request (Req_p3) with the following formula:

$$Req = Prop + Integr = \left[0.5 + \left(\frac{1}{Diff * 2} * e\right)\right] + \frac{1}{Diff * 2} * \left(\frac{1}{T_i} * \int edt\right)$$

where Kp(P1) is the constant of proportionality for the first sensor; Ti(P1)=at the integral time for the first point, Setpoint (P1) is the reference or setpoint pressure value for the first point; Kp(P3) is the constant of proportionality for the second sensor or second point; Ti(P3)=at the integral time for the second point, Setpoint (P3)=at the reference or setpoint pressure value for the second point, and wherein the deviations are thereby calculated $$e1=(p_{iP1}-p_{set_P1})$$

$$e2=(p_{iP3}-p_{setP3})$$

and wherein said control unit compares the two requests Req_p1 and Req_p3 at every instant i and choose the greater of the two as the total request with which to actuate said at least one or more devices.

10. A refrigeration plant including, or in combination with, a regulation apparatus according to claim 7.

11. A refrigeration plant according to claim 10, including a compression device, a heat exchanger, an ejector a receiver, an expander and an evaporator, wherein said refrigeration plant is configured so that a fluid leaving the compression device enters the heat exchanger and, leaving the heat exchanger, is introduced into a first inlet in the ejector, and wherein an outlet of the ejector is connected to the receiver, and wherein said receiver is connected to the evaporator to supply a liquid part of the fluid and is connected to the compression device to supply a gaseous part of the fluid, and wherein a further connection is provided between the evaporator and a second inlet of the ejector, and wherein a check valve is provided on a connecting section between the evaporator and the compression device, and wherein said first sensor is placed at the exit of the evaporator and positioned upstream of the check valve and said second point (P) is upstream of the compression device, downstream of said check valve, and wherein said first sensor identifies a pressure at the exit of the evaporator, before the check valve and wherein said regulation apparatus identifies in said second point (P3) a pressure entering the compression device, and wherein the first regulation request is a regulation request calculated downstream of the evaporator while the second regulation request is a regulation request calculated upstream of the compression device, and wherein the control unit checks which request is greater and consequently act on the capacity of the compression device.

12. The refrigeration plant according to claim 11, wherein a second sensor is arranged in said second point (P3).

13. A method for regulation of a refrigeration plant comprising at least one or more devices, wherein a path of refrigerant fluid is defined in the refrigeration plant and a plurality of devices are arranged along said path of refrigerant fluid, wherein the method provides for detecting a quantity (gi1) by means of a first sensor arranged at a first point (P1) along the refrigerant fluid path of the refrigeration plant, detecting a quantity (gi3) at a second point (P3) along the fluid path of the refrigeration plant, checking a first value of said quantity (gi1) measured by said first sensor and obtaining a first regulation request (Req_p1) of said at least one or more devices of the refrigeration plant deriving from said first measured value, checking a second value of said quantity (gi3) in said second point (P3) and deriving a second regulation request (Req_p3) of said at least one or more devices of the refrigeration plant deriving from said second value, comparing the first regulation request (Req_p1) with the second regulation request (Req_p3), and determining an improved safety regulation request that improves safety greater between the first regulation request (Req_p1) and the second regulation (Req_p3), actuating the improved safety regulation request for said at least one or more devices of the refrigeration plant.

14. The regulation method according to claim 13, wherein said at least one or more devices of the refrigeration plant to be controlled is a compressor or a plurality of compressors, and the improved safety regulation request is a greater regulation request corresponding to the total capacity of said one compressor or a plurality of compressors in the refrigeration plant.

15. The regulation method according to claim 14, wherein each step of deriving the first regulation request (Req_p1) and second regulation request (Req_p3) is a proportional regulation $$Req=Kp*e$$

or a request for proportional and integral regulation, also called P+I regulation, according to the equation $$Req = K_p * \left(e + \frac{1}{T_i} * \int edt\right)$$

where: Kp=gain linked to the differential by the relation:

$$K_p = \frac{1}{Diff * 2}$$

configured for said at least one device; and e=deviation (gi−gset)

that means a deviation between quantities, gi−gset, wherein gi means the quantity read by the respective sensor for the respective point at instant i and gset is the set point or reference quantity at instant i and Ti=Integral time [sec].

16. The regulation method according to claim 15, wherein the proportional contribution is a central band such that when the quantity gi corresponds to g et each first regulation request (Req_p1) and second regulation request (Req_p3) is 50%.

17. The regulation method according to claim 14, wherein each first regulation request (Req_p1) and second regulation request (Req_p3) are derived with the following formula:

$$Req = Prop + Integr = \left[0.5 + \left(\frac{1}{Diff * 2} * e\right)\right] + \frac{1}{Diff * 2} * \left(\frac{1}{T_i} * \int edt\right)$$

where Kp(P1) is the constant of proportionality for the first sensor; Ti(P1)=at the integral time for the first sensor, Setpoint (P1) is the reference or setpoint pressure value for the first sensor; Kp(P3) is the constant of proportionality for the second sensor or for the second point; Ti(P3)=at the integral time for the second point, Setpoint (P3)=at the reference or setpoint pressure value for the second point, and wherein the deviations are thereby calculated $$e1=(p_{iP1}-p_{set_P1})$$

$$e2=(p_{iP3}-p_{setP3})$$

and wherein each first regulation request (Req_p1) and second regulation request (Req_p3) is compared at each instant (i) and the greater of the first regulation request (Req_p1) and second regulation request (Req_p3) chosen as total request with which to actuate said at least one or more devices.

18. The regulation method according to claim 17, wherein the plant includes a compression device, a heat exchanger, an ejector a receiver, an expander and an evaporator, wherein said plant is configured so that a fluid leaving the compression device enters the heat exchanger and, leaving the heat exchanger, is fed into a first input in the ejector, and in which an output of the ejector is connected to the receiver, and wherein said receiver is connected to the evaporator to supply a liquid part of the fluid and is connected to the compression device to supply a gaseous part of the fluid, and wherein a further connection is provided between the evaporator and a second inlet of the ejector, and wherein a check valve is provided on a connecting section between the evaporator and the compression device, and wherein said first sensor is placed at the exit of the evaporator positioned upstream of the check valve and said second point is upstream of the compression device, downstream of said check valve, and wherein said first sensor is suitable to identify a pressure at the exit of the evaporator, before the check valve and wherein a pressure entering the compression device is identified, and wherein the first regulation request is a regulation request calculated downstream of the evaporator while the second regulation request is a regulation request calculated upstream of the compressor, and wherein it is verified which request is greater and consequently the capacity of the compression device is acted upon.

19. The regulation method according to claim 18, wherein each first regulation request (Req_p1) and second regulation request (Req_p3) are derived and compared continuously over time, so as to regulate the operation of said one or more devices based on the value of the greater request.

20. The regulation method according to claim 18, wherein the refrigeration plant includes a flash gas valve for the interception of gas coming from the receiver towards the compression device, and wherein a third probe or third sensor is provided, capable of measuring a pressure (P2) at the receiver, and wherein a pressure difference is measured between the pressure at the third probe with respect to the first probe, or with respect to a reference pressure value at the first probe, and the method provides for calculating a regulation request on the flash gas valve and acting on the flash valve gas to maintain said pressure difference within a predefined range and wherein in said second point (P3) a second probe or second sensor is provided for measuring the quantity in said second point (P3).

21. The regulation method according to claim 13, wherein said improved safety regulation request is a calculation having as output a relative percentage (%), and wherein said step of comparing the first regulation request with the second regulation request is a step of comparing relative percentages (%), the percentage (%) that improves safety greater being then chosen and translated into a regulation command.

* * * * *